US007841635B2

(12) United States Patent
Fuchs

(10) Patent No.: US 7,841,635 B2
(45) Date of Patent: Nov. 30, 2010

(54) APPARATUS FOR SECURING AND CARRYING A PACKAGE

(76) Inventor: Frank C. Fuchs, 9870 146th Ave., Fellsmere, FL (US) 32948

( * ) Notice: Subject to any disclaimer, the term of this patent is extended or adjusted under 35 U.S.C. 154(b) by 1141 days.

(21) Appl. No.: 11/505,028

(22) Filed: Aug. 16, 2006

(65) Prior Publication Data

US 2008/0042460 A1 Feb. 21, 2008

(51) Int. Cl.
*A45F 5/00* (2006.01)

(52) U.S. Cl. ..... 294/150; 294/153

(58) Field of Classification Search ..... 294/150, 294/153, 154, 165
See application file for complete search history.

(56) References Cited

U.S. PATENT DOCUMENTS

| | | | | |
|---|---|---|---|---|
| 265,742 | A | 10/1882 | Boteler | |
| 413,483 | A | 10/1889 | Bays | |
| 652,473 | A | 6/1900 | Cole | |
| 946,850 | A * | 1/1910 | Tabler | 294/149 |
| 1,174,328 | A | 3/1916 | Lien | |
| 2,416,602 | A * | 2/1947 | Wilson et al. | 294/157 |
| 2,532,306 | A | 12/1950 | Herbert | |
| 2,652,698 | A | 9/1953 | Schlumbohm | |
| 3,172,586 | A * | 3/1965 | Lu | 294/155 |
| 3,400,870 | A * | 9/1968 | Di Vietri | 294/150 |
| 3,865,292 | A * | 2/1975 | Foley | 294/149 |
| 3,933,287 | A * | 1/1976 | Foley | 294/149 |
| 4,018,467 | A * | 4/1977 | Salvesen | 294/31.2 |
| 5,445,276 | A | 8/1995 | Gordon | |
| 6,427,886 | B1 | 8/2002 | Essex | |
| 6,944,911 | B2 * | 9/2005 | Knoblauch | 294/170 |
| 6,953,214 | B2 * | 10/2005 | Paz | 294/157 |
| D564,761 | S * | 3/2008 | McGlenn | D3/327 |

* cited by examiner

*Primary Examiner*—Paul T Chin
(74) *Attorney, Agent, or Firm*—Hayworth, Chaney & Thomas P.A.; Robert A. Lynch; Stephen C. Thomas

(57) ABSTRACT

An apparatus for securing and carrying a package is disclosed, thereby facilitating inspection of the secured package at travel centers and security checkpoints given the quick-release nature of the apparatus and its ease and speed of reattachment to the package. The apparatus generally comprises a handle portion and two straps, wherein the straps are disposed perpendicular to one another and the ends of each strap, respectively, are releasably connected after being passed around a package. The releasable connections may comprise a variety of quick-release fasteners.

8 Claims, 5 Drawing Sheets

APPARATUS FOR SECURING AND CARRYING A PACKAGE

BACKGROUND

The invention relates to a carrying strap assembly. More particularly, the invention relates to a strap assembly which both releasably secures a package and facilitates carrying and inspection of the package.

A large object can be awkward for a single person to carry. Boxes or cartons generally do not have handles, which makes carrying them somewhat difficult. Moreover, oversized boxes may be unwieldy and difficult to manage, especially when containing fairly heavy items therein. In particular, when it is difficult to wrap one's arms around an object, the object can easily slip away. Also, even when a large object can be firmly held, it can throw the carrier 'off-balance'. Further, carrying a large object in an awkward position can quickly lead to fatigue and can lead to back problems, and other medical ailments.

Despite these difficulties, it is often necessary for a single person to carry a large box. In addition, it is often necessary for a single person to carry a large box a great distance. Boxes, packages, luggage, trunks, chests, coolers and the like are widely used for the storage, packing, and transportation of valuable articles. Many people also use such containers as luggage during travel, as can be noticeably seen at airports, train stations, bus depots and other travel centers. The prevailing reasons for such widespread usage of these containers and cartons is their availability, reusability, low cost, and overall ruggedness.

Exemplary travelers may range from people emigrating from foreign countries having all their worldly possessions in a large trunk, to recreational hunters returning home with an ice-packed cooler filled with game meat after a successful hunt. To provide any semblance of security to the items contained within such containers, a common practice among travelers is to seal the container closed with tape, tie the container closed with rope, or even wrap the container in plastic. This practice makes it inconvenient if ready access to the items contained therein is desired, since the relatively permanent nature of these remedies means that the package can be opened only by cutting or tearing the closure means, thereby making repacking and/or resealing difficult and sometimes impossible. Additionally, with recent heightened security measures at our airports and other travel centers, the tape, rope or plastic must be cut so that the contents of the container can be readily inspected by security personnel. As a result of such activity, during travel the items held within the container may spill out, resulting in their damage or destruction.

Over the years, people have proposed various devices that seek to help travelers in both securing and carrying a box, package, luggage, trunk, chest, cooler or the like.

U.S. Pat. No. 823,258 to Burton discloses a parcel carrying strap comprising a flexible bar and two straps having a sliding connection therewith and passing around the package in opposite directions, a portion of one of the straps being adapted to form a handle in conjunction with the flexible bar.

U.S. Pat. No. 2,532,306 to Herbert discloses an article carrying device comprising a plurality of straps secured one to the other to form a plurality of closed loops arranged to form a sling for receiving the articles to be carried, and means for constricting the sling into firm clamping relation to the article therein.

U.S. Pat. No. 3,865,292 to Foley discloses a book strap comprising three straps wherein two of the three straps are arranged so that when fastened to the package, an end portion of each defines a loop which serves as a handle to carry the package.

U.S. Pat. No. 6,193,293 to Ybanez discloses an apparatus for securing and carrying box-shaped cargo comprising a pair of retaining straps, a pair of horizontally disposed straps disposed to form adjustable loops, a cross strap and a pair of handles.

U.S. Pat. No. 6,953,214 to Paz discloses a box carrying strap assembly comprising a main strap, a pair of transverse straps and a handle strap composed of two separate handles extending along the main strap, where the straps are closed by mateable buckles.

Accordingly, there is a need for an apparatus for securing and carrying a package that is lightweight and durable, that is both easily securable to and easily removable from its package, that is economical to manufacture and can be stored virtually anywhere when not in use.

While the accomplishment of the above and related benefits of the invention may be embodied in the form illustrated in the accompanying drawings, attention is called to the fact, however, that the drawings are illustrative only. Variations are contemplated as being part of the invention, limited only by the scope of the claims.

Additionally, all patents, patent applications and publications discussed or cited herein are incorporated by reference to the same extent as if each individual publication or patent application was specifically and individually set forth in its entirety.

SUMMARY

The present invention pertains to an apparatus for securing and carrying a package that allows ready transportation and facilitates inspection of the package while traveling through airports, train stations, bus terminals and other travel centers. Further, the presently disclosed invention provides an apparatus that is lightweight, economical and capable of easily being stored when not in use.

An embodiment of the apparatus includes a ring member, a handle and two straps. The handle is diametrically attached to the ring member. The straps are disposed perpendicular to one another and the ends of the straps are releasably attached to the ring member after said straps have passed around said package. Also, at least one adjustment member is located on each strap. The adjustment members are capable of adjusting the length of each of the two straps so as to allow the apparatus to be used on packages of various sizes. Quick-release fasteners are used to facilitate the quick and easy attachment and detachment of the apparatus from the package, which is especially beneficial in quickly opening and then resecuring packages during security inspection while traveling.

Another embodiment of the apparatus includes a main strap having a handle portion, the handle portion comprising a length of the main strap folded back onto itself at a fold point providing an upper layer and a lower layer of the main strap with the upper layer and the lower layer of the handle portion being stitched to each other at a first stitch point located at a first end of the main strap and a second stitch point immediately adjacent the fold point, wherein the fold point of the main strap is releasably connected to a second end of the main strap after passing the main strap around the package, and a transverse strap extending perpendicular to the main strap, the transverse strap crossing the main strap at an intersection and the main strap and the transverse strap being stitched together at the intersection and the intersection being disposed at a midpoint of the lower layer of the handle portion, a first end of the transverse strap being releasably connected to a second end of the transverse strap after passing the transverse strap around the package.

DETAILED DESCRIPTION

The present invention pertains to a package securing and carrying apparatus that is just as easily removed from a package as it is attached to the package. Quick-release fasteners allow the quick-release of the apparatus when desired (i.e. at airport security) and further allow for rapid refastening thereafter. Thus, the apparatus quickly allows the package to be opened for inspection, and then rapidly resecured without destruction to the package securing means as often happens when tape, rope, plastic wrap and the like are employed.

Under the scope of this invention, the package which the disclosed apparatus secures and carries may be any parcel, package or item, including but not limited to, boxes, luggage, trunks, chests, coolers and the like.

"Stitching", "reinforced stitching" and "stitched", as used in the present disclosure, refer to all forms of conventional stitching know in the art, including but not limited to, a 'boxed x' stitch as exemplified in FIGS. 1-6.

Figure 1:
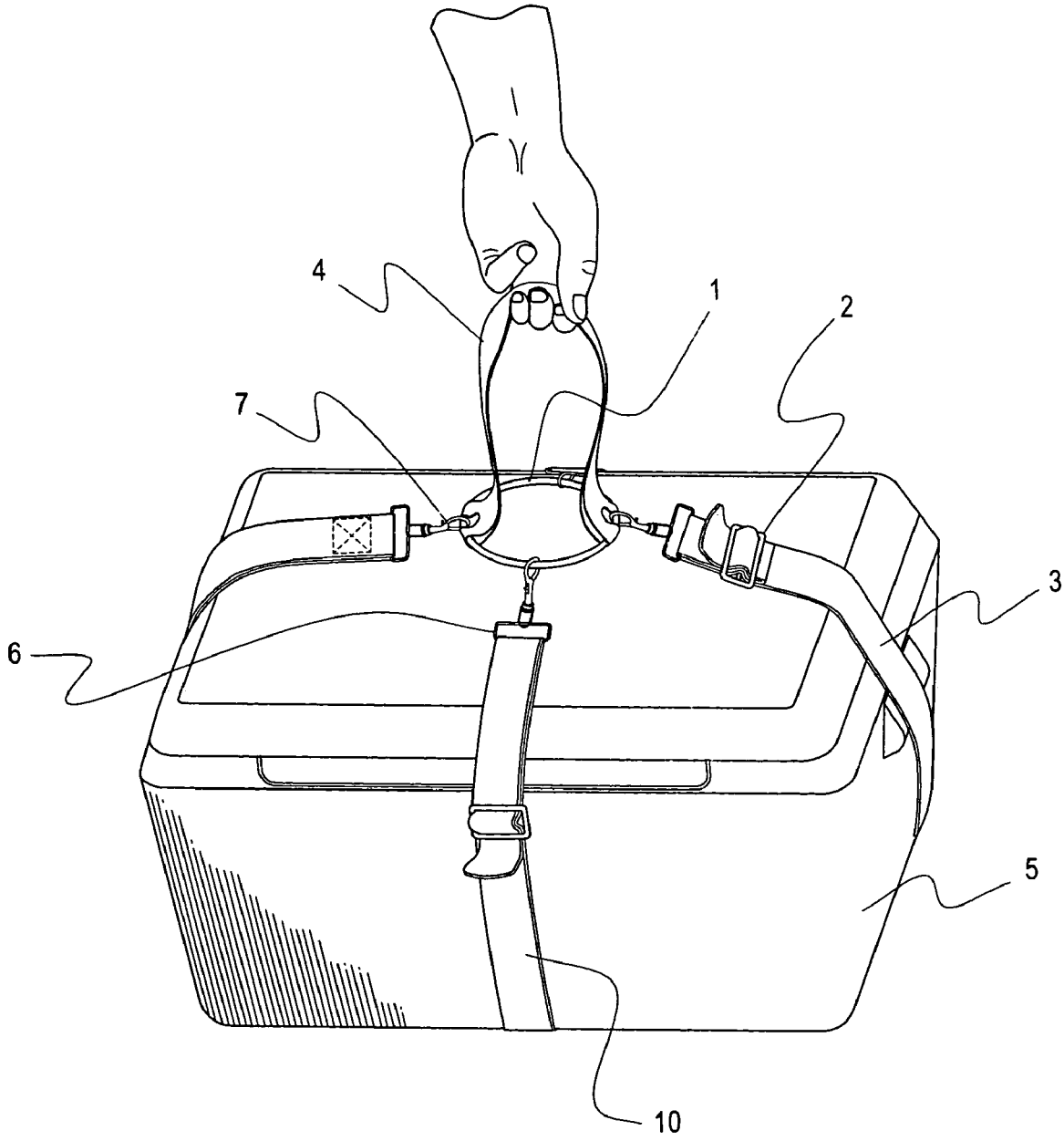
FIG. 1 is a perspective view of an embodiment of an apparatus for securing and carrying a package, shown secured around a cooler.

FIG. 1 shows an embodiment of the apparatus for securing and carrying a package 5, wherein a cooler represents the package 5. The apparatus is made from a ring member 1, a handle 4, a first 3 and a second 10 strap, and fasteners 7.

Figure 2:
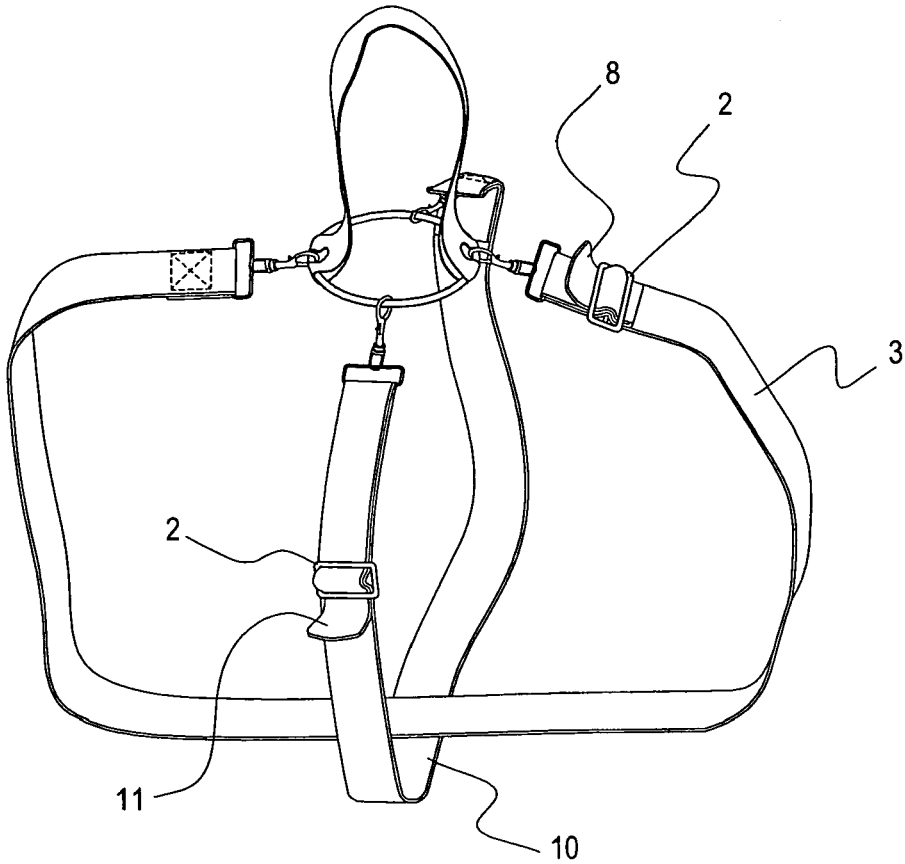
FIG. 2 is a perspective view of embodiment of an apparatus for securing and carrying a package depicted in FIG. 1, shown here without a package.

FIG. 2 shows the same embodiment of the apparatus for securing and carrying a package, without representing the package 5 (i.e. cooler of FIG. 1). The handle 4 is diametrically attached to the ring member 1. Handle 4 may be diametrically located at the same position on ring 1 as the connection points of first strap 3 or second strap 10 to ring 1. In such as case, an aperture may be cut in the ends of handle 4 at the midpoint of the width of handle 4, thus allowing fastener 7 access to ring 1.

As shown in FIG. 2, the first strap 3 is perpendicularly disposed to the second strap 10. Both ends of the first strap 3 and the second strap 10 are attached to the ring member 1 by fasteners 7 after straps 3, 10 are passed around package 5. Additionally, at least one adjustment member 2 is disposed on each of the two straps 3, 10.

As illustrated in the drawing figures, the handle 4 and each of the straps 3, 10 may be similar to that used in backpacks straps and the like. The handle 4 and straps 3, 10 may be made from materials, including but not limited to, rubber, polyester, polypropylene (i.e. polypropylene webbing), nylon, leather, canvas and the like. Preferably, handle 4 and straps 3, 10 of the present invention are composed of polypropylene webbing. To prevent fraying, aglets may be incorporated into the handle 4 and strap 3, 10 ends.

Adjustment members 2 are provided on the straps 3, 10. The adjustment members 2 facilitate adjustment of the length of the straps 3, 10, so as to allow the apparatus to be used on various size packages 5. Straps 3, 10 may be lengthened or shortened as necessary via the adjustment members 2 to encompass a variety of package 5 sizes. Once the package 5 is encompassed by straps 3, 10, wherein the straps 3, 10 are secured to the ring member 4, the adjustment members 2 are appropriately adjusted to shorten the straps 3, 10 and provide a secure fit. Adjustment members 2 may be in the form of slide fasteners (as shown in FIGS. 1 and 2), hook and loop structures (i.e. VELCRO™) on opposing strap 3, 10 surfaces, buckle assemblies, and the like. Furthermore, strap end 11 and strap end 8 may be secured to strap 10 and strap 3, respectively, by hook and loop structures (i.e. VELCRO™) on opposing surfaces of strap end 11 and strap 10, and strap end 8 and strap 3. Securing straps ends in this manner provides for ease of carrying, shipping, storing, and the like.

Figure 3:
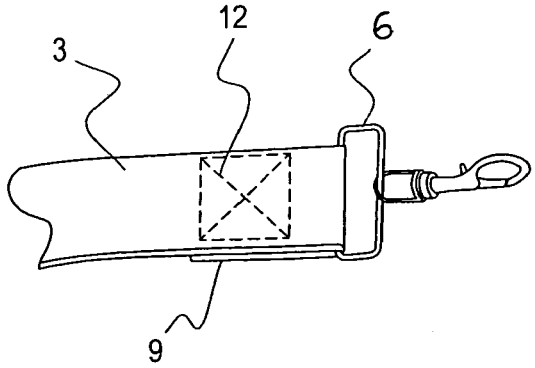
FIG. 3 is an illustration of specific embodiments of the strap ends and fasteners.

As shown in FIGS. 1 and 2, a fastener 7 is used to releasably attach each end of the straps 3, 10 to the ring member 4. Specifically, FIGS. 1-3 depict fastener 7 as a quick-release spring hook freely revolving around a hinge fitting 6. The hinge fittings 6 are shown to be movably held within fixed (via stitching) or adjustable loops at each end of both straps 3, 10. Fasteners 7 may take the form of may varieties known within the art, such as but not limited to, quick-release spring hooks, clips, conventional hooks, snaps, and the like.

FIG. 3 depicts an embodiment of one strap end on both the first strap 3 and the second strap 10. FIGS. 1-3 exemplify how one end 9 of both the first strap 3 and second strap 10 may be fixedly attached by reinforced stitching 12 to fastener 7 and its hinge fitting 6, while the opposing strap ends (as seen in FIGS. 1 and 2) are adjustably attached to fastener 7 and its hinge fitting 6 via adjustment members 2. Having only one side of each strap being adjustable simplifies the use of the apparatus in securing and releasing the package 5. However, another embodiment may incorporate adjustably attached fasteners 7, via adjustable members 2, on each and every strap end of the apparatus.

The ring member 4, fasteners 7 and adjustment members 2 may be made of materials commonly known and used in the field, such as metal and plastic. An essential attribute of such components is that they be capable of holding a strap in static position under relatively high tensile loading conditions (i.e. customary luggage weight ranges) imposed on the straps 3, 10.

Accordingly, it will be seen that this invention provides for relatively simple, lightweight and economical means for securing, handling, carrying and transporting a variety of sized packages. Referring now to FIG. 1, once secured on the package 5, the apparatus can be used to easily carry the package 5, set it down on the ground when necessary, quickly release from the package 5 by simply releasing fasteners 7 from ring member 4 to allow for inspection of the package 5, and then reattach the apparatus onto the package to once again ease its transport while maintaining the integrity of package 5 and its contents.

Figure 4:
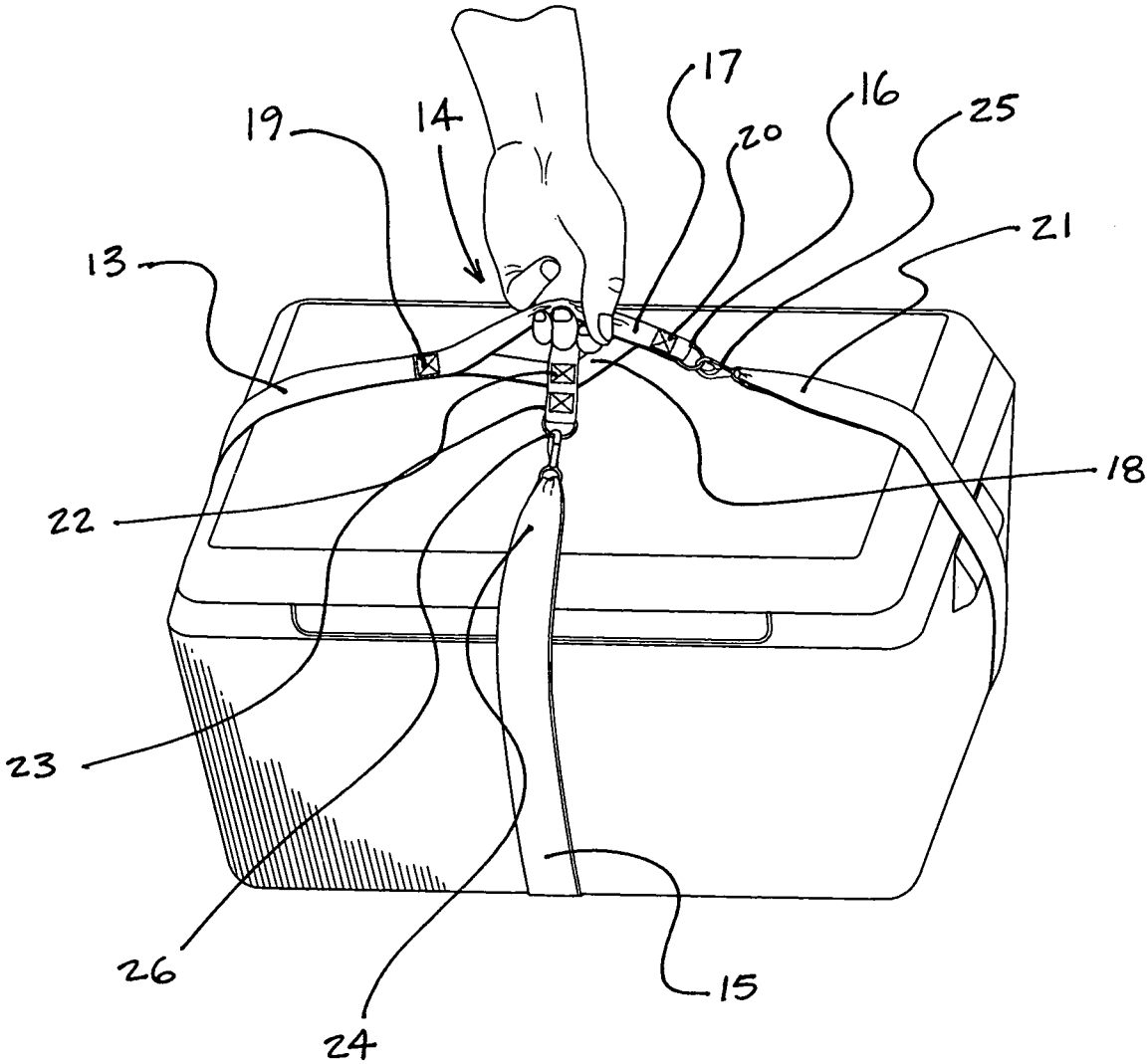
FIG. 4 is a perspective view of another embodiment of an apparatus for securing and carrying a package, shown secured around a cooler
Figure 5:
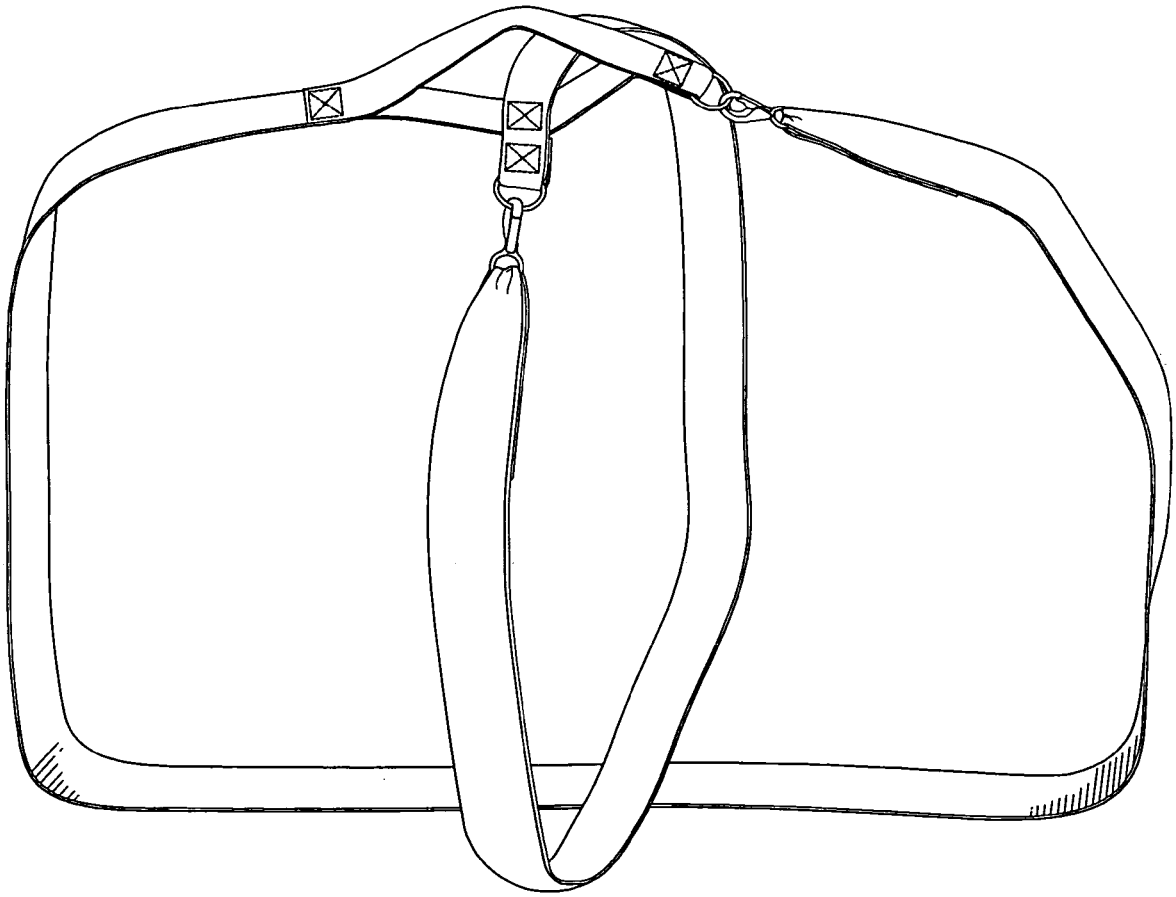
FIG. 5 is a perspective view of an embodiment of an apparatus for securing and carrying a package depicted in FIG. 4, shown here without a package.

Referring to FIG. 4 and FIG. 5, another embodiment of the present invention is depicted comprising a main strap 13 having a handle portion 14, and a transverse strap 15. Handle portion 14 is made from an end portion of main strap 13 folded back onto itself at a fold point 16. When folded back on itself, main strap 13 forms an upper layer 17 and a lower layer 18. Both layers are stitched together at the first end of main strap 13 at a first stitch point 19. Both layers are also stitched together immediately adjacent fold point 16, creating a second stitch point 20. To allow the quick release of a package being carried, fold point 16 of main strap 13 is releasably connected to the second end 21 of main strap 13.

Transverse strap 15 is used to securely encompass the package to be carried. Transverse strap 15 extends perpendicular to main strap 13 and crosses and is stitched to main strap 13 at an intersection 22 located at the midpoint of lower layer 18 of handle portion 14. To further allow the quick release of a package being carried, first end 23 of transverse strap 15 is releasably connected to second end 24 of transverse strap 15.

The apparatus depicted in FIGS. 4 and 5 may additionally comprise at least one adjustment member on main strap 13 and at least one adjustment member on transverse strap 15. Such adjustment members are capable of adjusting the length of main strap 13 and transverse strap 15 so as to allow the apparatus to be fully adjustable and therefore enabling it to be used on packages of varying sizes. These adjustable members may include any conventional adjustable members known in the art, such as but not limited to, slide fasteners, hook and loop fasteners on opposing surfaces of said straps, and buckle assemblies. In the embodiment where such adjustment members are utilized, loop and hook closures (i.e. VELCRO™) may be utilized to secure the loose end of straps 13 and 15 against straps 13 and 15.

Allowing the quick release of both main strap 13 and transverse strap 15 provides for an efficient means to quickly secure a package and its contents, while also enabling a rapid disengaging of straps to facilitate a search of the package (i.e. at airports and border crossings).

The releasable connections 25,26 of main strap 13 and transverse strap 15, respectively, can be formed by any conventional releasable connectors, such as but not limited to, quick-release spring hooks, clips, conventional hooks, hook an loop closures (i.e. VELCRO™), snaps, and quick-release hook fasteners attached to mateable rings. The mateable rings, depicted in FIGS. 4-6, may be utilized in a variety of forms including that of a circular ring or that of a "D-ring" configuration that acts to disperse the package loading pressure across the width of the strap by means of contacting the straight portion of the D-shaped ring.

Figure 6:
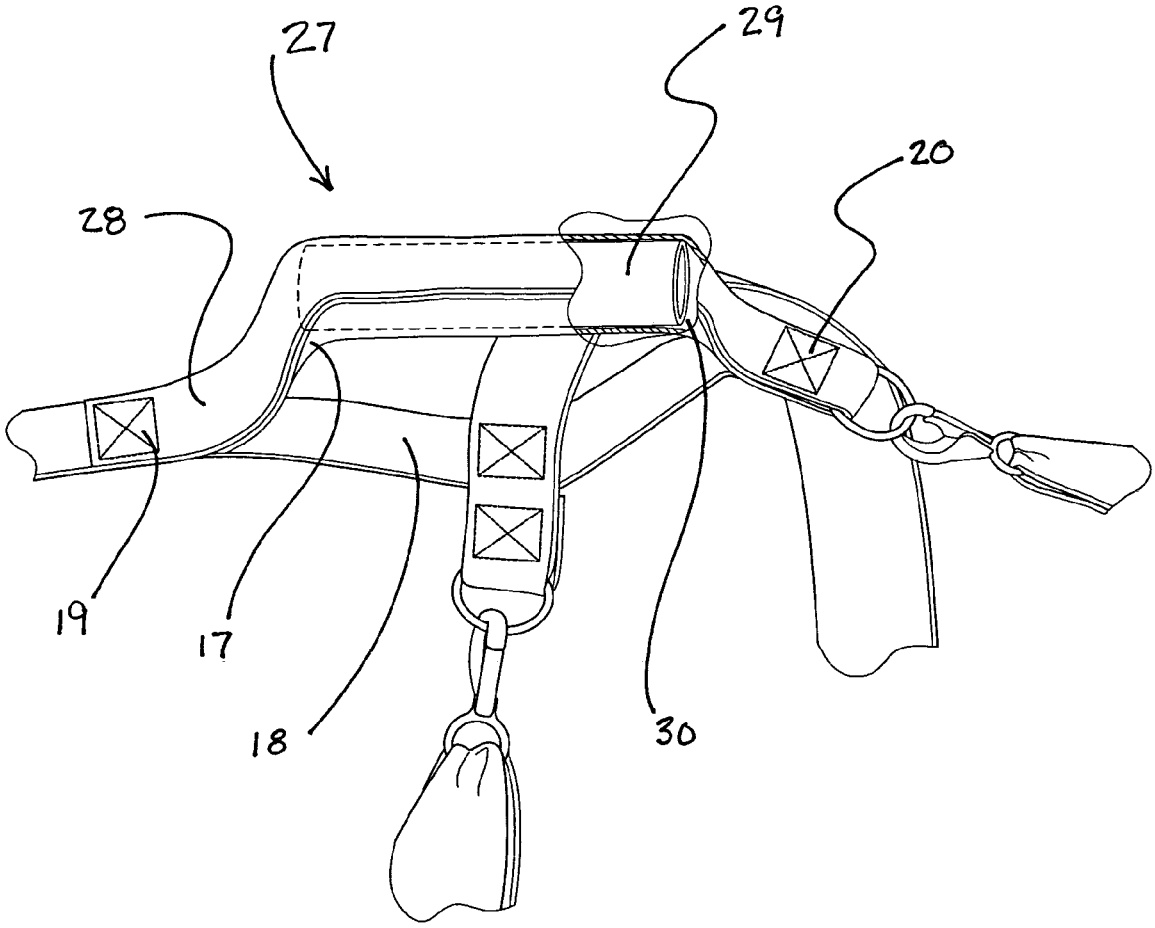
FIG. 6 is an enlarged view of an embodiment of the handle portion of the apparatus for securing and carrying a package depicted in FIG. 4 and FIG. 5.

As depicted in FIG. 6, handle portion 27 may further comprise supplemental strap 28 and length of tubing 29. The supplemental strap 28 is used to assist in enclosing tubing 28 in order to provide an ergonomic handle design that more comfortably disperses the package load pressure more efficiently across the user's hand. Supplemental strap 28 overlays, in parallel, upper layer 17 of handle portion 27. Tubing 29 is enclosed within a compartment 30 defined by supplemental strap 28 and upper layer 17. Supplemental strap 28 is stitched to upper layer 17 at first stitch point 19 and second stitch point 20, as described above. To fully enclose tubing 29 within compartment 30, the longitudinal edges of supplemental strap 28 are stitched to the respective longitudinal edges of upper layer 17, thus forming compartment 30.

Length of tubing 29 may be constructed of any conventional lightweight tubing known to be able to withstand weight or force common to traveling goods such as luggage and large packages. Preferably, length of tubing 29 may be composed of polyvinyl chloride (PVC) tubing.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. An apparatus for securing and carrying a package, comprising: a main strap having a handle portion, said handle portion comprising a length of said main strap folded back onto itself at a fold point providing an upper layer and a lower layer of said main strap with said upper layer and said lower layer of said handle portion being stitched to each other at a first stitch point located at a first end of said main strap and a second stitch point immediately adjacent said fold point, wherein said fold point of said main strap is releasably connected to a second end of said main strap after passing said main strap around said package; and a transverse strap extending perpendicular to said main strap, said transverse strap crossing said main strap at an intersection and said main strap and said transverse strap being stitched together at said intersection and said intersection being disposed at a midpoint of said lower layer of said handle portion, a first end of said transverse strap being releasably connected to a second end of said transverse strap after passing said transverse strap around said package wherein said handle portion further comprises a supplemental strap and a length of tubing, said supplemental strap overlaying said upper layer of said handle portion in a parallel configuration and said supplemental strap being stitched to said upper layer at said first stitch point and said second stitch point, said supplemental strap and said upper layer of said handle portion being further stitched together along the longitudinal edges of said supplemental strap and said upper layer of said handle portion thus defining a compartment, wherein said length of tubing is disposed within said compartment defined by said supplemental strap and said upper layer of said handle portion for enhancing the comfort and ergonomic qualities of said handle portion.

2. The apparatus for securing and carrying a package of claim 1, wherein said releasable connections of said main strap and said transverse strap are selected from the group consisting of quick-release spring hooks, clips, conventional hooks, snaps, and quick-release hook fasteners attached to mateable rings.

3. The apparatus for securing and carrying a package of claim 1, wherein said straps and said handle portion are constructed of material selected from the group consisting of rubber, polyester, polypropylene, nylon, leather, and canvas.

4. The apparatus for securing and carrying a package of claim 1, wherein said straps and said handle portion are constructed polypropylene webbing.

5. The apparatus for securing and carrying a package of claim 1, wherein said length of tubing is comprised of polyvinyl chloride.

6. The apparatus for securing and carrying a package of claim 1, wherein said apparatus further comprises at least one adjustment member on said main strap and at least one adjustment member on said transverse strap, said adjustment members capable of adjusting the length of said main strap and said transverse strap so as to allow said apparatus to be used on said package of varying sizes.

7. The apparatus for securing and carrying a package of claim 6, wherein said adjustment members are selected from the group consisting of slide fasteners, hook and loop fasteners on opposing surfaces of said straps, and buckle assemblies.

8. An apparatus for securing and carrying a package, comprising:

a main strap having a handle portion, said handle portion comprising a length of said main strap folded back onto itself at a fold point providing an upper layer and a lower layer of said main strap with said upper layer and said lower layer of said handle portion being stitched to each other at a first stitch point located at a first end of said main strap and a second stitch point immediately adjacent said fold point, wherein said fold point of said main strap is releasably connected to a second end of said main strap after passing said main strap around said package;

a transverse strap extending perpendicular to said main strap, said transverse strap crossing said main strap at an intersection and said main strap and said transverse strap being stitched together at said intersection and said intersection being disposed at a midpoint of said lower layer of said handle portion, a first end of said transverse strap being releasably connected to a second end of said transverse strap after passing said transverse strap around said package;

said releasable connections of said main strap and said transverse strap comprising quick-release hook fasteners attached to mateable rings;

said handle portion further comprising a supplemental strap and a length of tubing, wherein said length of tubing is comprised of polyvinyl chloride, said supplemental strap overlaying said upper layer of said handle portion in a parallel configuration and said supplemental strap being stitched to said upper layer at said first stitch point and said second stitch point, said supplemental strap and said upper layer of said handle portion being further stitched together along the longitudinal edges of said supplemental strap and said upper layer of said handle portion thus defining a compartment, wherein said length of tubing is disposed within said compartment defined by said supplemental strap and said upper layer of said handle portion for enhancing the comfort and ergonomic qualities of said handle portion; and at least one adjustment member on said main strap and at least one adjustment member on said transverse strap, said adjustment members being slide fasteners capable of adjusting the length of said main strap and said transverse strap so as to allow said apparatus to be used on said package of varying sizes.

* * * * *